United States Patent [19]

Buck, Jr. et al.

[11] 3,997,942

[45] Dec. 21, 1976

[54] BATT FORMING AND FEEDING APPARATUS

[75] Inventors: George S. Buck, Jr.; Roger Russell, both of Memphis, Tenn.

[73] Assignee: Cotton, Incorporated, Raleigh, N.C.

[22] Filed: Dec. 12, 1974

[21] Appl. No.: 532,001

[52] U.S. Cl. ..... 19/155

[51] Int. Cl.[2] ..... D01G 25/00

[58] Field of Search ..... 19/105, 204, 155, 128, 19/115 R, 106 R

[56] References Cited

UNITED STATES PATENTS

| | | | |
|---|---|---|---|
| 159,923 | 2/1875 | Harwood | 19/105 |
| 1,129,167 | 2/1915 | Chase | 19/204 |
| 2,044,460 | 6/1936 | Bartram et al. | 19/128 X |
| 2,234,280 | 3/1941 | Roberts, Jr. | 19/204 |

FOREIGN PATENTS OR APPLICATIONS

| | | | |
|---|---|---|---|
| 1,830 | 1862 | United Kingdom | 19/106 R |
| 2,660 | 1881 | United Kingdom | 19/105 |
| 2,854 | 1877 | United Kingdom | 19/105 |
| 15,293 | 1893 | United Kingdom | 19/105 |

*Primary Examiner*—Dorsey Newton
*Attorney, Agent, or Firm*—Burns, Doane, Swecker & Mathis

[57] ABSTRACT

Apparatus for the formation and feeding of a cotton batt including a cotton retention chamber in which a first conveyor conveys cotton in a generally lateral direction toward a batt exit opening in a chamber and a second conveyor of the endless belt type with a lower drive roll conveys cotton away from the opening in an upward direction generally transverse to the lateral direction to establish a rotating batt supply body in the chamber. A rotatable stripper disposed between the front end of the first conveyor and the lower drive roll of the second conveyor forms the exit opening between the stripper and the front end of the first conveyor, and strips a batt from the supply body. The lower drive roll of the second conveyor is driven from the same drive means as the stripper and may be adjustable in an arcuate path about the axis of rotation of the stripper so that the angle the second conveyor makes with the first conveyor can be adjusted to expedite the operation of the apparatus without changing the adjustment of the size of the batt exit opening. Also the size of the batt exit opening may be independently adjusted by adjusting the front end of the stripper. The stripper may include a cylindrical hollow drum having a plurality of circumferentially and longitudinally spaced, circumferentially extending, slots, which drum is driven by fingers from an eccentric driver roll that moves outwardly and inwardly of the slots.

2 Claims, 12 Drawing Figures

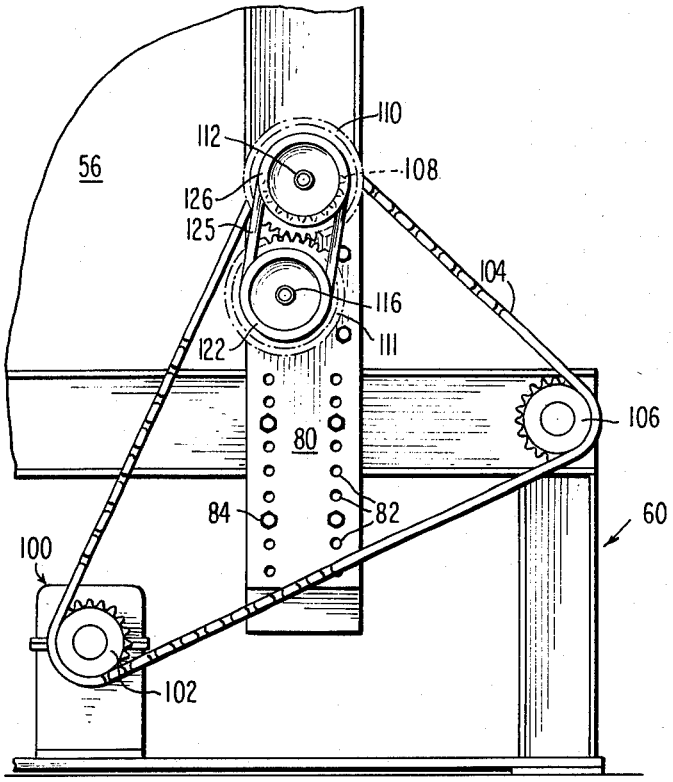
FIG. 3
FIG. 6
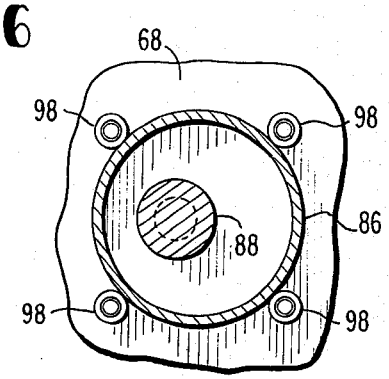
FIG. 7
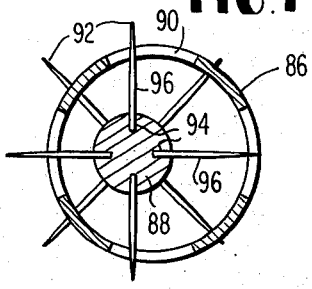
FIG. 5
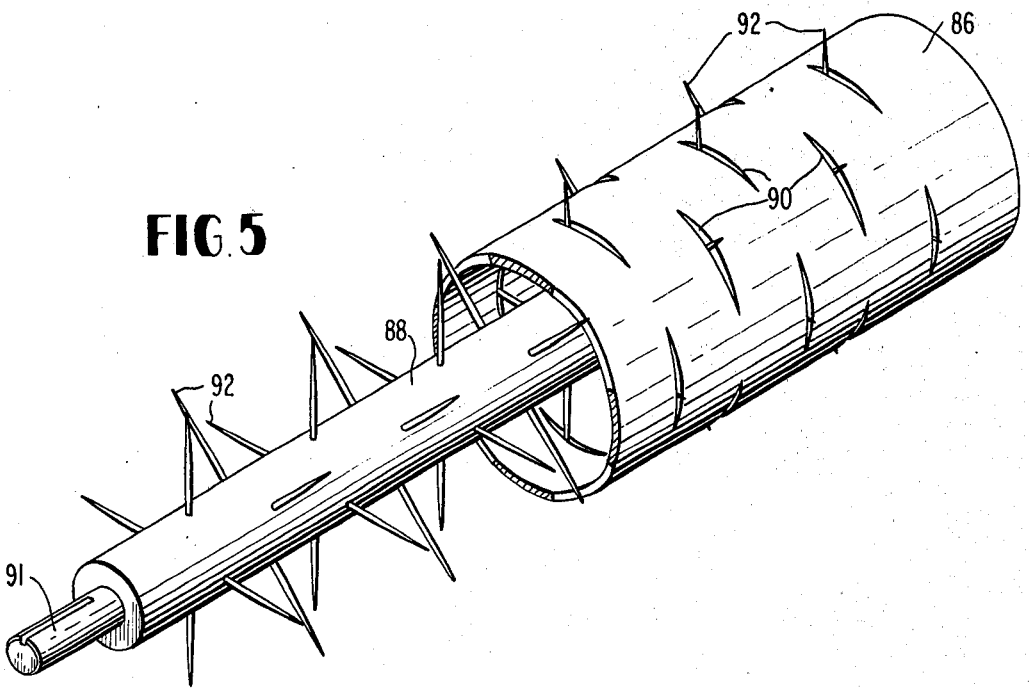

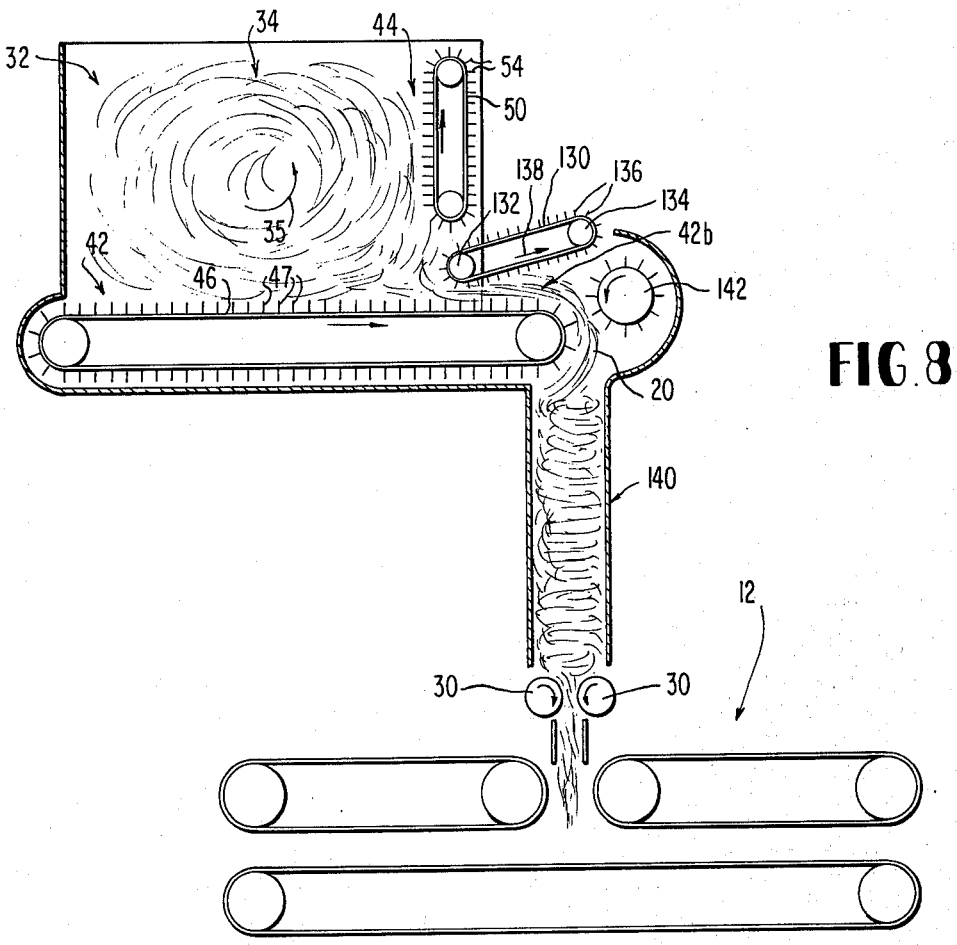
FIG. 8
FIG. 9
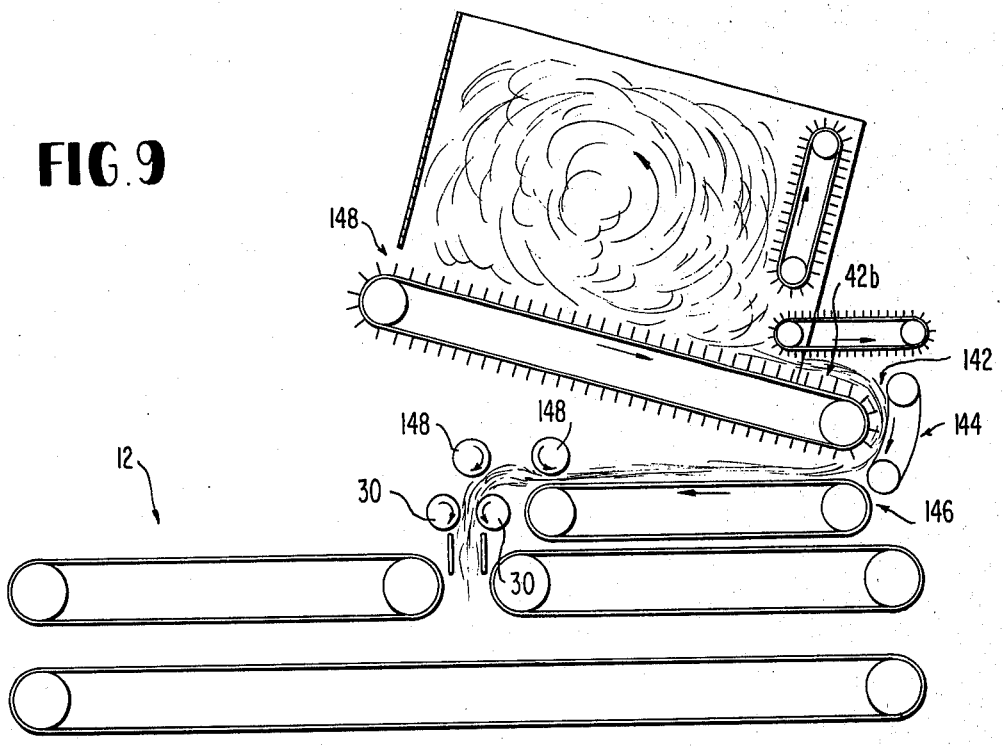

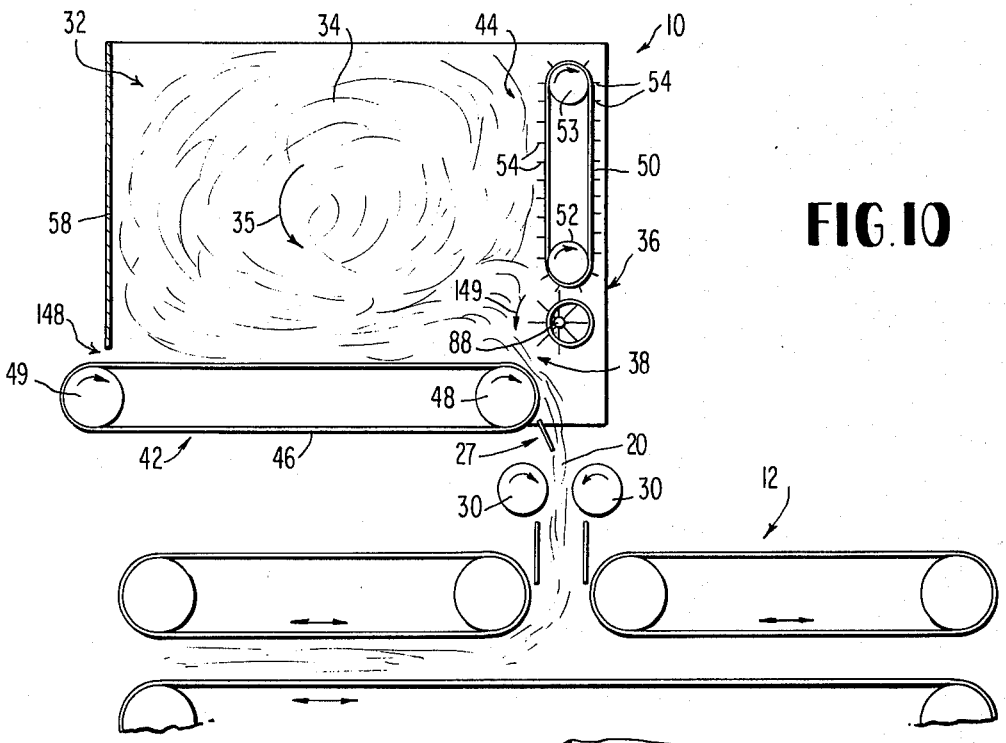
FIG. 10
FIG. 11
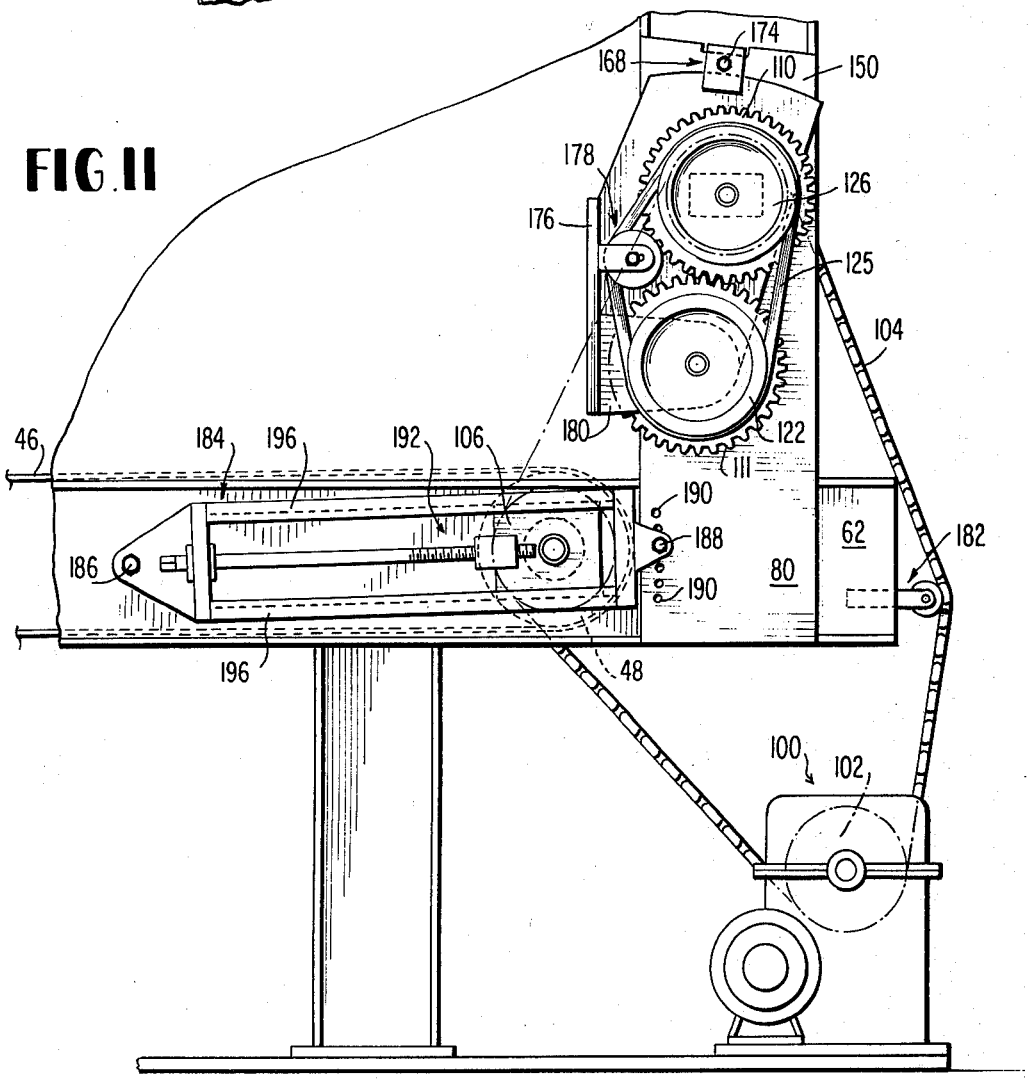

BATT FORMING AND FEEDING APPARATUS

BACKGROUND OF THE INVENTION

This invention relates to the formation and feeding of a batt of fibrous material.

In particular, this invention relates to the formation and feeding of a cotton batt, and more specifically to the formation and feeding of such a batt in connection with the formation of cotton bales by the successive compression of overlapping layers of cotton provided by folding the batt into itself.

In this regard, reference may be had to our copending application Ser. No. 532,008 filed concurrently herewith for "Cotton Packaging Method and Apparatus" and issued as U.S. Pat. No. 3,948,021 on Apr. 6, 1976, the disclosure of which is hereby incorporated by reference. As pointed out in that disclosure, a cotton batt is directed between a batt feeding opening, defined between two upper platens, into a bale forming zone disposed between those platens and a lower platen. The platens include compression and conveying surfaces which operate, as the batt is folded upon itself, to form a compressed cotton bale in stages.

It is also pointed out in that disclosure that other proposals have contemplated formation of cotton bales through the application of pressure over the area of successive cotton layers. Those proposals have not, however, specified in detail the manner in which a batt is to be provided.

Batts have been provided in the past in various cotton handling operations. While prior techniques for forming and feeding such batts might be desirable for some purposes, they may not be entirely suitable insofar as batt uniformity and/or amenability to adjustments for batt thickness are concerned.

Although some prior batt forming operations may be acceptable insofar as uniformity is concerned, they will not be entirely compatible with bale forming systems involving the application of pressure over the area of successive layers of cotton. For example, in continuous ginning operations a cotton batt is essentially continuously formed utilizing conventional condensor techniques. But, during a bale formation operation involving the application of pressure over the area of a successive cotton layers, there may be times when it becomes necessary or desirable to interrupt feeding of a batt to the bale making equipment. It would, however, be undesirable to similarly interrupt the ginning and forming processes.

OBJECTS AND SUMMARY OF PREFERRED FORMS OF THE INVENTION

Recognizing the foregoing, it is a general object of the present invention to provide a novel method and apparatus for forming and feeding a batt of fibrous material.

It is a particular object of the present invention to provide such a novel method and apparatus wherein batt uniformity is enhanced.

It is a further object of the present invention to provide such a novel method and apparatus that is particularly compatible with a cotton bale forming system involving the application of pressure over the area of successive cotton layers.

It is another object of the present invention to provide such a novel method and apparatus wherein the thickness of the batt is readily adjustable.

It is a still further object of the present invention to provide such a novel method and apparatus wherein a supply body from which a batt may be produced may be formed independently of the production and feeding of the batt.

It is yet another object of the present invention to provide such a novel method and apparatus that may employ a batt from another operation as all or a portion of the precursor of the batt ultimately supplied.

A preferred form of the invention intended to accomplish at least some of the foregoing objects entails a method and apparatus for forming and feeding a batt of fibrous material, preferably cotton. According to method aspects of the invention the cotton is collected and a circulation of the collected cotton is enforced to establish a rotating, generally cylindrical cotton batt supply body. The mass of fibrous material constituting the rotating body is peeled to strip the body of cotton and to form a batt. The batt so formed is transported for further use.

Preferably, the method of the present invention entails the step of building up the batt supply body through the enforced circulation of supplied cotton at least in part provided by a batt formed by conventional techniques.

Apparatus aspects of the present invention involve the collection of the fibrous cotton in a retention chamber means including a batt exit opening. Circulation means is employed to enforce circulation of enough cotton in the retention chamber to establish the cotton batt supply body. Body stripping means rotatable in the same angular direction as the rotating supply body (and in the opposite direction to the rotation of the circulation means) is engagable with the batt supply body thereby to strip or peel the body of cotton to form the batt.

Exit conveyor means is operable to transport the formed batt through the batt exit opening.

Preferably, the circulation means includes first circulation conveyor means for conveying cotton in a first direction towards said batt exit opening, and second circulation conveyor means for conveying cotton away from the batt exit opening in a second direction transverse to the first direction. The body stripping means is disposed adjacent the batt exit opening between the first and second circulation conveyor means.

Advantageously, the exit conveyor means and the first circulation conveyor means comprise an elongated conveyor assembly including an endless belt means forming a floor of the cotton retention chamber means.

In one preferred form the stripping means comprises a generally cylindrical, hollow stripper drum with a plurality of circumferentially and longitudinally spaced openings therein. Stripper drum support means mounts the stripper drum for free rotation adjacent the retention chamber exit opening. Pick roll means may be mounted within the interior of the stripper drum. Such pick roll means includes a plurality of circumferentially and longitudinally spaced, generally radially extending fingers that, when the pick roll is operatively supported, protrude through the drum openings. The pick roll means is mounted for rotation about an axis eccentric to the axis of rotation of the stripper drum.

Drive means is operable to rotate the pick roll means about the eccentric axis in an angular direction opposite to that of the circulation conveyor means, thereby to rotate the stripper drum through engagement of the protruding fingers with the drum. Those fingers are operable to retract within the stripper drum during a portion of the rotating travel of the pick roll means.

Formation of the supply body may be enhanced by a pick roll drive means being selectively operable to rotate the pick roll means in the same annular direction as the circulation conveyor means.

If desired, the cotton retention chamber means may include a batt entry opening adjacent the endless conveyor assembly forming the floor of the retention chamber means. A batt formed in another operation may thereby be supplied into the retention chamber means by the first circulation conveyor means. This batt may provide all or a portion of the precursor for formation of the rotating supply body. In this connection, the pick roll means may be rotated in the same direction as the circulation conveyor means so as to aid in blocking exit of the precursor cotton batt from the retention chamber means and force it into the supply body.

The thickness of the batt leaving the batt exit opening may be adjusted by providing adjustment means for altering the relative displacement of the first circulation conveyor means and the stripping means adjacent the exit opening. Moreover, the angle between the first and second circulation conveying directions adjacent the exit opening can be adjusted to enhance the stripping actions of the stripping means on the batt supply body.

Feedroll means may be provided for feeding the batt leaving the exit opening.

Other objects and advantages of the present invention will become apparent from the following detailed description of preferred forms thereof. In conjunction with the accompanying drawings in which like reference characters represent like functioning elements and in which:

THE DRAWINGS

FIG. 3 is a partial side elevational view showing the drive means for the circulation conveyors and the stripping means of the apparatus shown in FIG. 2;

FIG. 5 is a perspective view of the stripping means employed in the apparatus of FIG. 2, with the stripper drum partially deleted for clarity;

FIG. 6 is a partial sectional view showing the mounting of the stripper drum;

FIG. 7 is a cross-sectional view of the pick roll and stripper drum of FIG. 5;

FIGS. 8, 9 and 10 are sectional schematic illustrations similar to FIG. 1 showing further forms of apparatus according to the present invention;

FIG. 11 is a partial side elevational view depiciting adjustment features of the apparatus shown in FIG. 10.

DETAILED DESCRIPTION

General Summary

Figure 1:
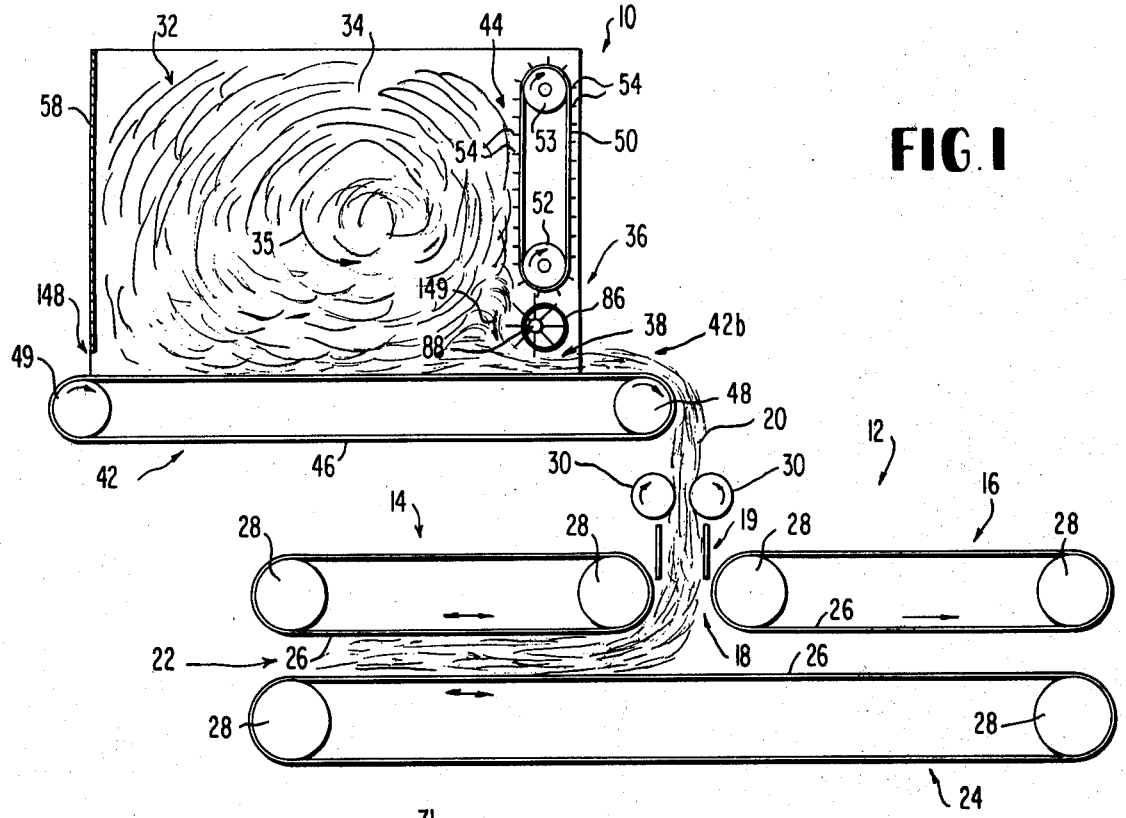
FIG. 1 is a sectional view schematically depicting one preferred form of an apparatus for forming and feeding a cotton batt, in accordance with the present invention, the batt being fed to a schematically illustrated cotton bale forming apparatus.

With reference now to FIG. 1, one preferred form of the cotton batt forming and feeding apparatus in accordance with the present invention may be seen schematically depicted. The batt forming and feeding apparatus is indicated generally at 10 as being disposed in operative relative relationship to a schematically depicted portion of a bale forming system indicated generally at 12. This bale forming system may be of the type disclosed in the aforementioned concurrently filed application Ser. No. 532,008, the disclosure of which has been incorporated by reference above.

The illustrated portion of the bale forming system 12 includes two upper press platens 14 and 16 which are suitably mounted so as to define therebetween a batt feeding opening 18. A batt 20 of cotton, formed and fed in accordance with the present invention, is directed through the batt feeding opening 18 for entry into a bale forming zone 22. This bale forming zone 22 is a zone of controlled height disposed between the upper platens 14 and 16 and a lower platen 24.

Each of the platens includes a compression and conveying surface 26 attached to an endless chain entrained around sprockets schematically indicated at 28. The lower platen 24 is biased under the pressure of hydraulic cylinders (not shown) toward the upper platens 14 and 16 to provide the compression force during bale formation.

As set forth in the previously identified co-pending application, the compression and conveying surfaces reciprocate to fold the batt 20 upon itself and to form a compressed cotton bale in stages. The batt 20 may be directed into the bale forming zone 22 where this occurs by means of suitably mounted, closely spaced feed rolls 30 aligned with the batt feeding opening 18. A suitably supported guide chute schematically shown at 19 may extend from beneath the feed rolls 30 into the batt feeding opening 18 between the upper press platens 14 and 16.

The remainder of the batt forming and feeding apparatus 10 is suitably mounted above the feed rolls 30 and includes a cotton retention chamber 32. Preferably, this retention chamber is generally box-shaped and has a length dimension substantially the same as its height dimension. The width of the chamber is selected to substantially correspond to the desired width of the batt 20 to be formed.

Cotton supplied to the chamber 32 is collected in a manner described more fully hereinafter, and a circulation of the collected cotton is enforced in the retention chamber to establish a rotating, generally cylindrical cotton batt supply body, indicated in FIG. 1. The direction of rotation of the body 34 is indicated by the arrow 35. Body stripping means shown at 36 is rotatable adjacent the supply body 34 and is engageable with the supply body of cotton to form batt 20. The generally circular movement of fluffy lint provided in the retention chamber or hopper 32 minimizes voids and enhances the establishment of a uniform density of fiber to aid in ensuring a uniform weight of the batt that is formed.

The batt so formed is transported through a batt exit opening 38 in the retention chamber 32. From there the batt 20 passes between the feed rolls 30 to be directed into the batt feeding opening 18 between the platens 26 and 28.

Detailed Structure

In the illustrated embodiment of FIGS. 1–7, the enforced circulation of the cotton in the retention chamber 32 and the resultant formation of the batt supply body 34 is accomplished utilizing a plurality of circulation conveyors. As will be appreciated from FIG. 1, one circulation conveyor 42 is operable to convey cotton in the first direction toward the batt exit opening 38. A second circulation conveyor 44 is operable to convey cotton away from the batt exit opening 38 in a second direction transverse to the first direction. As illustrated, the body stripping means 36 is disposed between the first and second circulation conveyors 42 and 44.

In the illustrated embodiment of the present invention an extension 42*b* of the first circulation conveyor 42 also provides an exit conveyor for transporting the batt through the batt exit opening 38. This circulation and exit conveyor 42, including the extension section 42*b*, is in the form of an elongated conveyor assembly comprised of an endless belt 46 that forms a floor of the cotton retention chamber 32. The endless belt 46 is entrained around suitable rolls 48 and 49, one of which may be driven.

Figure 2:
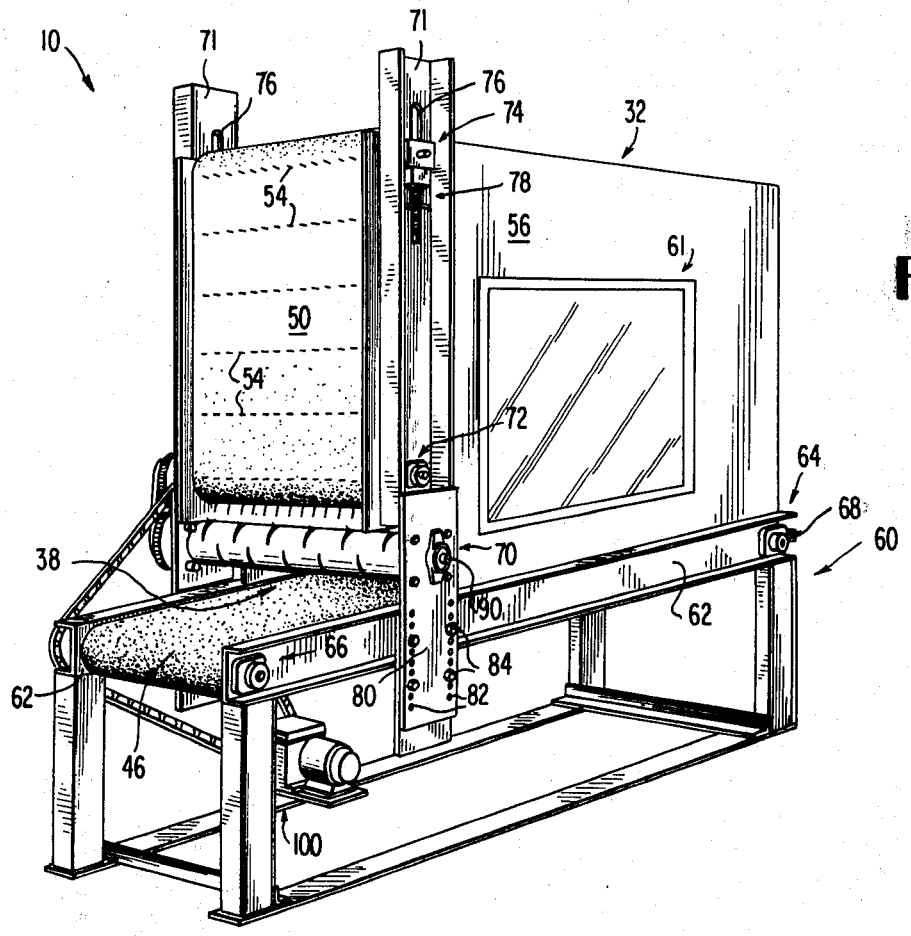
FIG. 2 is a perspective view of portions of the apparatus schematically shown in FIG. 1.

As best seen in FIG. 2, an endless belt 50 of the second circulation conveyor 44 constitutes the major portion of the front wall of the retention chamber 32. This belt 50 is entrained about two rolls 52 and 53, one of which may be suitably driven. The belt 50 of the second circulation conveyor 44 is depicted as being arranged generally orthogonal to the belt 46 forming the floor of the retention chamber. As will be described more fully below in connection with FIGS. 10–12, some adjustments of this orientation may be made. In addition, this belt 50 is provided with a plurality of rows and columns of spikes 54.

The previously identified stripping means 36 is disposed immediately below the second circulation conveyor 44 in alignment therewith. The stripper means 36 thus also constitutes a portion of the front wall of the retention chamber 32, with the spacing between the stripping means 36 and the floor conveyor belt 46 being such as to define the batt exit opening 38. The spacing between the stripping means 36 and the second circulation conveyor 44 thereabove is such as to generally impede any exiting the flow of cotton into that space. Of course, as will become apparent, the spikes 54 on the conveyor belt 50 also tend to carry away the cotton from that space.

Preferably, when the orientation of the elongate second circulation conveyor 44 is adjusted relative to the first circulation conveyor 42 as discussed below with reference to FIGS. 10–12, the relative spacing between the stripper means 36 and the second circulation conveyor 44 is maintained constant.

The sidewalls 56 and the rear end wall 58 of the retention chamber 32 may be formed of suitable material such as smooth metal plate. These walls 56 and 58 may be welded to one another and may be suitably mounted on a frame 60 on which they are disposed in an upstanding posture. If desired, one sidewall 56 may be provided with a window 61 to allow for convenient viewing of the interior of the retention chamber 32 where the batt supply body 34 is formed.

Included in the frame 60 on which the walls of the retention chamber 32 are mounted are longitudinally extending supports 62 that mount the rolls 48 and 49 of the lower conveyor assembly 42, as indicated at 64 and 66. The longitudinally extending supports 62 are provided with slots at the rear, idle roll mounting location 64 in order to allow the distance between the front drive roll 48 and the rear idle roll 49 to be adjusted by a suitable adjustment mechanism indicated at 68. In this fashion the belt 46 entrained about the rolls 48 and 49 may be fully tensioned, and frictionally driven by the drive roll 48.

The spacing between the longitudinally extending supports 62 is, of course, sufficient to accommodate a width of the belt 46 corresponding to the desired width of the batt 20 to be formed.

At the forward end of the retention chamber, two upwardly extending supports 71 are provided. As indicated at 70, 72 and 74, the stripping means 36 and the drive roll 52 and the idle roll 53 of the second circulation conveyor assembly are supported thereby. At the support location 74 of the idle roll 53, the upright supports 71 include slots 76. A suitable adjusting means 78 cooperates with these slots 76, and appropriate slots in the sidewalls 56, to adjust the spacing between the idle roll 53 and drive roll 52. As in the case of the similar adjustment for the lower belt 46, the belt 50 entrained about these rolls may be thus fully tensioned, and frictionally driven by the drive roll 52.

The lower ends of the upright supports 71 are comprised of a flange 80 including a plurality of mounting apertures 82. Suitable fasteners 84 cooperate with these apertures 82 to permit vertical adjustment of the upright supports 71. As such, the adjustable mounting means for these supports 71, on which the stripping means 36 and the second circulation conveyor 44 are supported, constitutes means for adjusting the thickness of the batt 20 peeled from the supply body 34 by the stripping means 36, in a manner more fully described below, by altering the relative displacement of the stripping means 36 and the first circulation conveyor 42.

The stripping means 36 schematically shown in FIG. 1 includes a rotatable stripper drum 86 and a rotatable pick roll 88 shown in more detail in FIGS. 5–7.

In FIG. 5 it may be seen that the stripper drum 86 is a hollow, generally cylindrical member of any suitable material, for example steel. The drum is provided with a plurality of circumferentially and longitudinally spaced openings 90 therein. These openings 90 are generally elongate in the circumferential extent of the drum 86, and are operable to receive projecting fingers or picks 92 mounted on the pick roll 88.

These picks 92 project generally radially from the pick roll 88 at circumferentially and longitudinally spaced locations corresponding to those of the apertures 90 in the stripper drum 86. Those locations are such that, during operation, the picks 92 may pass between adjacent ones of the spikes 54 in the various rows thereof on the belt 50 of the second circulation conveyor 44.

The pick roll 88 itself may be a solid, generally cylindrical member including radially inwardly projecting receiving apertures 94 in which the fingers 92 are mounted. (See FIG. 7)

In its orientation mounted within the interior of the stripper drum 86, the pick roll 88 is disposed for rotation about an axis off-set from the axis of the stripper drum 86. (See FIG. 6) By reason of this eccentric mounting, the picks 92 of the pick roll 88 protrude through the stripper drum apertures 90 by their greatest extent along the circumferential face of the drum nearest the rotating supply body 34. The dimensions of the picks 92 are such that they retract toward the interior of the stripper drum 86 during continued rotation of the pick roll 88 in the direction of rotation shown in FIG. 1.

With renewed reference to FIG. 5, it may be seen that the ends of the pick roll 88 are necked down to form end shafts 91. These shafts are suitably mounted on the upright support members 71 of the support frame 60 so as to define the axis of rotation of the pick roll. One such shaft 91 is driven, in a manner described more fully below, to effect rotation of the pick roll.

During rotation of the pick roll 88, picks 92 projecting through the stripper drum slots 90 engage the stripper drum 86 and cause rotation thereof in the same direction as the pick roll rotation direction. As shown in FIG. 6, bearings 98 are disposed on the inwardly facing sides of the generally upright support members 71 at diagonal locations where they engage the external periphery of the stripper drum 86 and support that drum for essentially free rotation.

Figure 4:
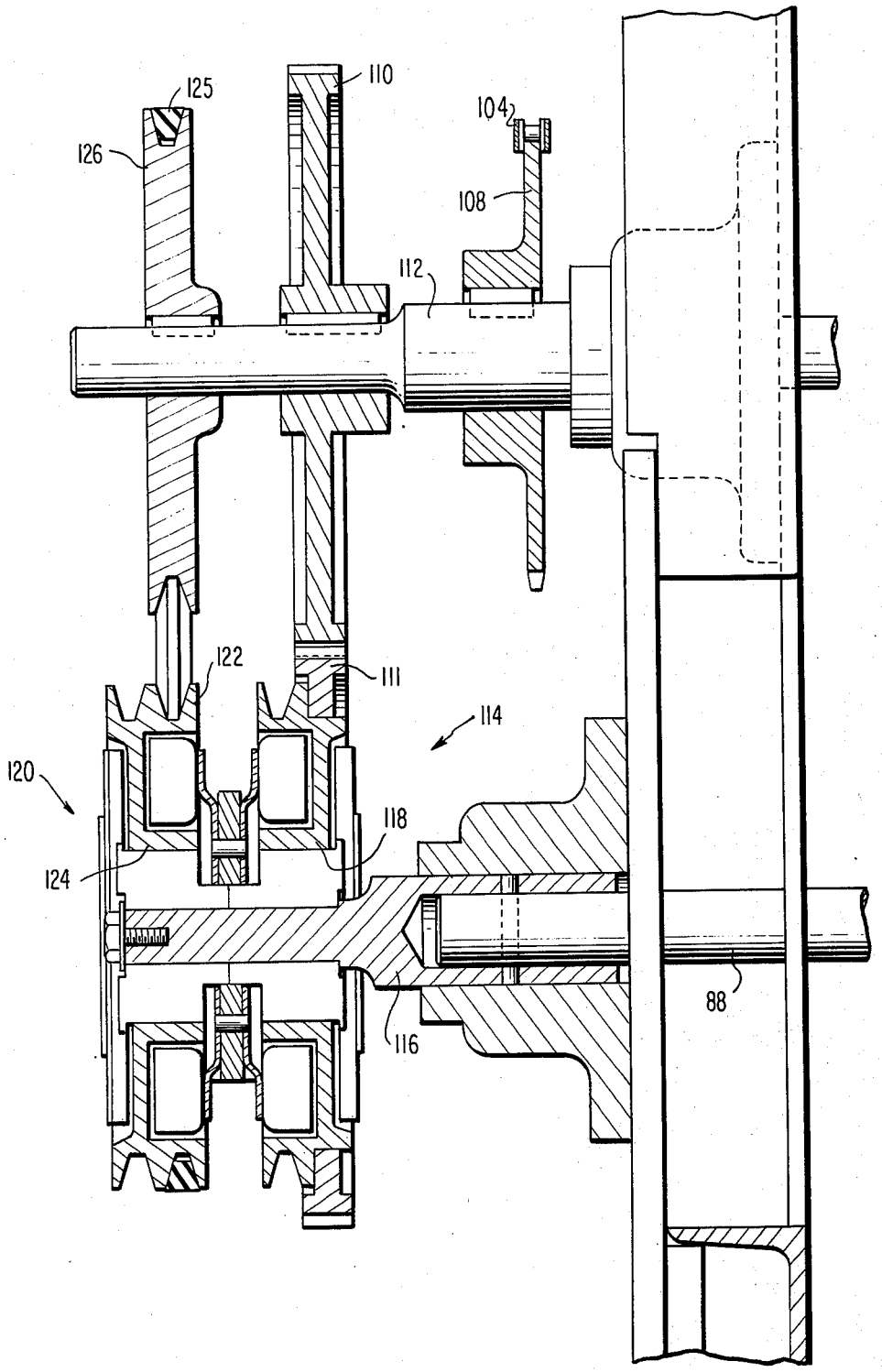
FIG. 4 is a sectional view showing the drive means of FIG. 3.

Referring now to FIGS. 3 and 4, the manner in which the stripping means 36 and first and second circulation conveyors 42 and 44 are rotated may be understood.

For this purpose, a suitable drive motor 100 may be mounted on the support frame 60. The drive motor includes a sprocket 102 in driving engagement with a drive chain 104. This drive chain transmits rotary motion from the drive sprocket 102 associated with the drive motor 100 to driver sprockets 106 to 108 respectively associated, in driving relationship with the drive rolls 48 and 52 of the first and second circulation conveyors 42 and 44. If desired, the input drive to the drive sprocket 102 may alternatively be provided by interconnecting the drive sprocket with the bale forming system 12 so that the two systems are synchronized.

When the drive motor 100 or other input causes clockwise rotation (as viewed in FIG. 3) of its associated sprocket 102, the chain 104 causes a similarly directed rotation of the driven sprockets 106 and 108, thereby to rotate each of the conveyor belts 46 and 50 in a clockwise direction (as viewed in FIG. 1) by frictional engagement thereof with the drive rolls 48 and 52. During this rotation, cotton in the retention chamber is urged toward the forward end of the retention chamber by the first circulation conveyor 42, and the spikes 54 of the second circulation conveyor 44 engage the cotton urged toward the forward end so as to tend to lift that cotton. The combined action of the circulation conveyors 42 and 44 tends to rotate the batt supply body 34 in a counterclockwise direction, as indicated by the arrow 35 in FIG. 1.

As will be appreciated, rotation of the stripping means 36 in the same direction as the supply body 34 (i.e., counterclockwise as viewed in FIG. 1) and opposite to the direction of rotation of the circulation conveyors 42 and 44 is operable to cause a batt to be peeled or stripped from that body. In accordance with a preferred form of the present invention, such rotation may be accomplished by gearing the drive for the second circulation conveyor 44 to the drive for the pick roll 88.

For this purpose gears 110 and 111 are provided (see FIG. 4). One such gear 110 is mounted on a shaft 112 aligned with drive roll 52 of the second circulation conveyor 44. This shaft 112 also mounts, and is driven by, the drive sprocket 108 associated with the second circulation conveyor. Rotation of the shaft 112 effects rotation of the drive roll 52 through a suitable coupling.

When the drive sprocket 108 is rotated in a clockwise direction to similarly rotate the drive roll 52, the gear 110, suitably keyed to the shaft 112, also is rotated in the clockwise direction. This rotation causes counterclockwise rotation of the other gear 111 in mesh therewith.

This latter gear 111 is formed as a part of a gear and clutch assembly 114 mounted on a shaft 116 aligned with the axis of the pick roll 88. (See FIG. 4.) Rotation of this shaft 116 in a given angular direction transmits similar rotation to the pick roll 88 through a suitable coupling.

Such rotation of the shaft 116 and the pick roll 88 in a counterclockwise direction may be accomplished upon energization of a conventional electromagnetic clutch portion 118 of the gear and clutch assembly 114. When that electromagnetic clutch 118 is energized in a conventional manner by a suitable circuit (not shown), counterclockwise rotation transmitted to the gear and clutch assembly 114 is also transmitted to the shaft 116.

At times when it is desirable to interrupt formation and feeding of the batt 20, the electromagnetic clutch portion 118 of the gear and clutch assembly 114 is maintained in a deenergized posture. The gear and clutch assembly 118 then rotates freely about the shaft 116.

If desired, the stripping means 36 may be maintained at rest at those times. However, as in the case of the illustrated embodiment provision may be made to rotate the stripping means 36 in a clockwise direction (as viewed in FIG. 1) so that the stripping means may function as part of the means for circulating the cotton in the retention chamber.

In this connection, a conventional pulley and clutch assembly 120 may be mounted on the shaft 116 on which the gear and clutch assembly 114 is mounted. (See FIG. 4.) The pulley and clutch assembly 120 includes a pulley portion 122 and an electromagnetic clutch portion 124. Driving of the pulley portion 122 of this assembly is accomplished by a belt 125 driven by a pulley 126 keyed to the shaft 112 on which the drive sprocket 108 for the second circulation conveyor is mounted. The pulley portion 122, and thus the pulley and clutch assembly 120, is continuously driven in a clockwise direction of rotation, so that upon energization of the clutch portion 124, the shaft 116 and the pick roll are also caused to rotate in that clockwise direction. At other times, the pulley and clutch assembly 120 freely rotates about the shaft 116.

A suitable circuit may provide for automatically switching the two clutches 124 and 118 between alternate engaged and disengaged modes.

It will be appreciated that other arrangements for two directional rotation of the stripping means 36 may be provided if such bi-directional rotation capacity is desired. For example, a separate and reversible drive train independent of the drive train for the circulation conveyors may be employed.

FIGS. 8 and 9 each schematically depict an alternative apparatus for forming and feeding a batt in accordance with the present invention. As in the case of the embodiment of FIGS. 1–7, a retention chamber 32 and two circulation conveyors 42 and 44 are provided. The belt 46 of the lower conveyor 42 which forms the floor of the retention chamber 32 may, if desired, include spikes 47, as does belt 50 of the generally upwardly extending conveyor 44.

The apparatus of FIG. 8 and the apparatus of FIG. 9 are generally similar to that of FIG. 1 with the exception of the stripping means 36. The stripping means 36 in FIG. 8 takes the form of an additional frictionally driven belt 130 entrained about a suitably mounted drive roll 132 and a suitably mounted idle roll 134. This belt is provided with spikes indicated at 136.

The spikes 136 on the belt 130 are operable, upon rotation of the belt in the direction of the arrow 138, to peel the batt supply body 34 formed by the circulation conveyors 42 and 44.

It will be appreciated that, if desired, the direction of rotation of the belt 130 of the stripping means 36 may, by utilization of a drive train similar to that described in connection with FIGS. 3 and 4, be reversed to enhance formation and rotation of the batt supply body 34.

In both the embodiments of FIGS. 8 and 9, the lower conveyor 42 includes an extension 42*b* beyond the confines of the retention chamber. This extension provides an exit conveyor section as in the case of the embodiment of FIG. 1.

In the embodiment of FIG. 8, the batt 20 exiting from the end of the exit conveyor section 42*b* is directed into a cross-sectionally rectangular metering column 140. A rotatable spiked brush 142 may be disposed slightly above and adjacent the end of the exit conveyor section 42*b* to aid in directing the batt 20 into the metering column 140. From the metering column 120 the batt passes between feed rolls 30 to a bale forming system 12 such as that described in connection with FIG. 1.

In the FIG. 9 embodiment, the batt 20 emerging over the end of the exit conveyor section 42*b* may be guided through a guiding zone 142 formed by a suitably curved conveyor belt assembly 144 with a curvature complementing the end of the conveyor section 42*b*. The batt 20 so guided may be transported by a further conveyor assembly 146 to the feeding rolls 30, and then to the bale forming system 12. Adjacent the zone where the batt 20 leaves the further conveyor 146, batt compression rolls 148 may be provided to aid in controlling the thickness of the batt.

Figure 12:
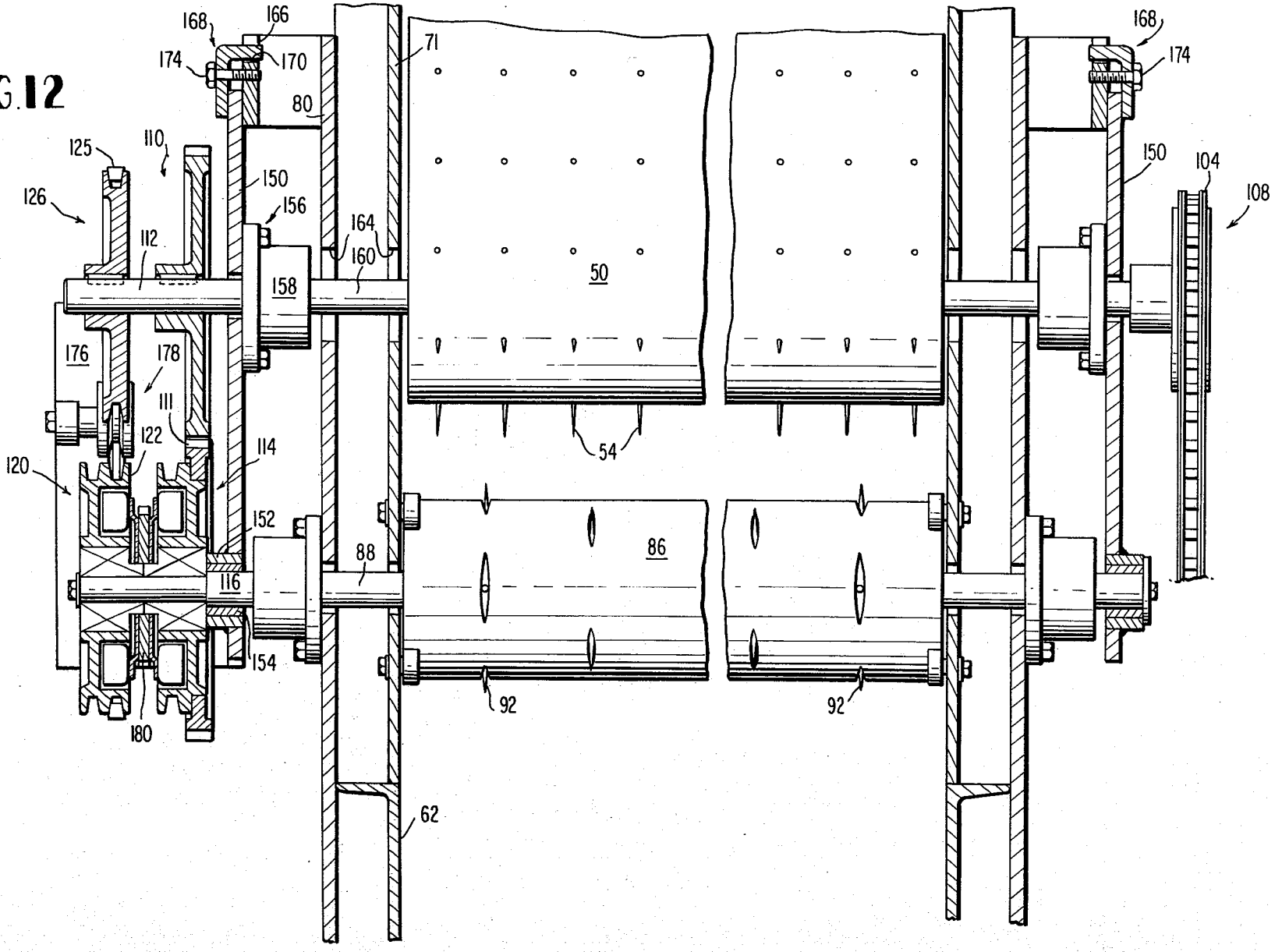
FIG. 12 is a sectional view showing the drive means and adjustment features of the apparatus of FIG. 10.

With reference to FIGS. 10–12, a modified form of the apparatus of FIGS. 1–7 may be seen. In this form of the apparatus, the roll 48 adjacent the forward exit opening 38 is preferably located slightly rearward of the body stripping means 36, and the batt 20 leaves the exit opening 38 at about a forty-five degree angle to the vertical. If desired, a guide plate 27 may be suitably mounted in a position angularly disposed to extend in the direction of exit of the batt 20 so as to establish additional guidance of the batt toward the feed rolls 30.

It will be appreciated that, since the lower circulation conveyor 42 does not extend beyond the exit opening 38 as in the case of the extension 42*b* of the apparatus of FIG. 1, these feed rolls 30 constitute the main part of the exit conveyor means for the batt.

As earlier noted, provision is made for adjustment of the orthogonal orientation of the conveyors belts 50 and 46 depicted in FIG. 10. In this connection, the drive roll 52 of the second circulation conveyor 44 is mounted for arcuate movement about the axis of rotation of the pick roll 88. This allows for inclining the face of the belt 50 of that conveyor 44 slightly away from the batt supply body 34. It has been found that such outward inclination enhances the ability of the stripping means 36 to peel the body 34, perhaps by reason of the configuration of the body 34 being altered to include an "angled corner" adjacent the stripping means 36 as the lower circulation conveyor 42 urges the body 34 toward the front of the chamber 32. At any rate, the adjustment is particularly useful in ensuring that the body 34 can be fully peeled even when peeling is accomplished on an interrupted basis.

For purposes of the adjustment just described, an adjustment plate 150 is provided. This plate 150 may be attached to a sleeve bearing 152 rotatably supported on a further bearing 154, which in turn is mounted on the shaft 116 transmits rotation to the pick roll 88 from the gear and clutch assembly 114 or the pulley and clutch assembly 120 as earlier described.

Bolted to the adjustment plate 150 as indicated at 156 is a bearing housing 158 associated with the drive shaft 160 for the drive roll 52 of the upper conveyor assembly 44 and with the shaft 112 that transmits motion from the gear 110 ultimately to the pick roll 88. Thus, the drive roll 52 of the upper conveyor assembly 44 is carried by the adjustment plate 150 so that arcuate movement of that adjustment plate 150 about the pick roll axis swings the drive roll 52 about that axis.

In this fashion, the inclination of the upper circulation conveyor belt 50 relative to the direction of extent of the lower circulation conveyor belt 46 is accomplished. When the second circulation conveyor is so adjusted, its relative relationship to the stripping means 36 is maintained constant since that stripping means is mounted on the adjustment plate.

The previously mentioned belt tension adjusting means 78 (see FIG. 2) may be employed in conjunction with belt inclination adjustment to ensure friction driving of a fully tensioned belt 50.

In order to accommodate arcuate movement of the drive shaft 160 for the drive roll 52, arcuate slots 164 are provided in the upright support member 71 and the flanged extension 80 thereof adjacent the zone of that shaft 160. As will be noted, this flanged extension 80 projects above the height of the upper circulation conveyor drive roll 52 unlike the case in connection with the apparatus depicted in FIG. 2.

At the upper end of the flanged extension 80 a projecting bracket 166 is provided. In the illustrated assembly of FIG. 12, one leg of a generally L-shaped clamp 168 is receivable in a slot 170 of the bracket. The other leg of the clamp 168 overlaps and is engageable with the adjustment plate 150.

A screw 174 in threaded engagement with the slotted bracket 166 is operable to urge that leg of the clamp 168 against the adjustment plate 150 and the adjustment plate 150 against the outer face of the bracket 166. In this manner, the adjustment plate 150 is releasably clamped in pivotally adjusted positions.

From FIGS. 11 and 12, it may be seen that a projecting arm 176 attached to the adjustment plate 150 carries an adjustable idle roller 178 about which the pulley belt 125 that couples the pulleys 126 and 122 passes. This allows for adjustment of tension in that pulley belt 125 in various angular positions of the adjustment plate.

Also carried by the projecting arm 176 is a plate 180 that extends between the pulley and clutch assembly 120 and the gear and clutch assembly 114. This plate is rotatable about the fixed axis of those assemblies 120 and 114 during adjustment of the adjustment plate 150.

In order to accommodate the adjustment plate 150 adjacent the gear 110 that transmits motion to the pick roll 88, the driver sprocket 108 that drives the upper conveyor assembly drive roll 42 is disposed on the side of the apparatus opposite that gear 110 (see FIG. 12). The driver sprocket 106 associated with the lower conveyor assembly drive roll is similarly disposed (see FIG. 11), as is a tension adjustment member 182 for the chain 104.

An essentially indentical adjustment plate 150 and associated clamp 168 is also located on that side of the apparatus.

As in the case of FIGS. 1–7, in the embodiment of FIGS. 10–12 adjustment of the thickness of the batt 20 leaving the exit opening 38 is also accomplished by altering the relative displacement of the first circulation conveyor 42 and the stripping means 36 adjacent that exit opening. However, rather than providing for adjustment of the flange extensions 80 of the upright supports 71 relative to the longitudinally extending supports 62, provision is made for pivotally mounting the drive roll 48 of the lower circulation conveyor 42.

For this purpose, an elongate mounting bracket assembly 184 is disposed on each of the longutidinally extending supports 62. Each such bracket assembly 184 is rotatable by a pivot bolt 186 extending through one end thereof and supporting the bracket assembly on the longitudinally extending support. The other end of each bracket assembly 184 is releasably supported by a bolt 188 cooperable with one of a plurality of holes 190 in the upright flange projection 80. These holes 190 are disposed in an arc so as to permit disposition of the mounting bracket assemblies 184 and the drive roll 48 carried thereby, in a plurality of arcuate positions.

As will be apparent, the longitudinally extending support members 62 are appropriately slotted to accommodate such adjustment of the drive roll 106. Through such adjustment, the extent of the lower conveyor belt 46 can be angled toward or away from the stripping means 36.

The earlier mentioned belt tension adjustment mechanism 68 (see FIG. 2) and an additional adjustment mechanism 192 associated with blocks 194 that carry the drive roll 48 allow slack in the belt 46 to be removed. The blocks 194 travel along guide rails 196 forming part of the elongate mounting bracket assemblies 184.

Operation

According to the present invention, a cotton batt produced in another operation (e.g. by conventional condensor technique) may be used to form all or a portion of the precursor of the batt 20 ultimately supplied. In this connection, the lower portion of the rear wall 58 of the retention chamber 32 may be spaced from the lower circulation conveyor 42 to provide a precursor batt entrance opening. Such an entrance opening is indicated at 148 in FIGS. 1, 9 and 10.

A precursor cotton batt of, for example, a batt about three inches thick produced by a condensor, may be supplied in any suitable manner, onto the portion of the conveyor belt 46 which projects beyond the rear wall 58 of the retention chamber 32. The first circulation conveyor 42 is driven in the manner previously described and operates to convey the supplied cotton toward the front wall of the retention chamber.

Initially, i.e., when the retention chamber is all or partially empty, the stripping means 36 at the front of the chamber is either not driven or it is driven in a direction opposite to that indicated by the arrow 149 in FIGS. 1 and 10. Eventually, a build up of cotton will take place within the interior of the chamber 34 adjacent the stripping means.

At this point it may be noted that it is preferable to space the stripping means 36 from the lower circulation conveyor by an amount less than the thickness of the precursor batt so as to impede significant exit of cotton from the chamber during initial batt formation. In addition, it is preferable to reverse rotate the stripping means 36 during initial batt formation so that the picks 92 of the stripping means tend to lift the cotton conveyed toward the front end of the chamber and thus to further impede such exit.

After cotton build up sufficient to reach the zone adjacent the second circulation conveyor 44 occurs, that continuously driven conveyor 44 tends to lift the cotton. Cotton is continually added to the chamber 32 and the two circulation conveyors 42 and 44 enforce a circulation of that cotton to establish the rotating supply body 34. As will be appreciated, if the stripping means 36 is reverse rotated, it forms a part of the circulation means.

The batt supply body 34 is generally cylindrical in nature. As used herein, that term is meant to include the configuration of a body adjacent the zone of the stripping means 36 where cotton buildup occurs, whether or not the "angled corner" adjustment earlier described in connection with FIGS. 10–12 is employed.

When it is desired to form and feed the batt 20, the stripping means 36 is rotated in an angular direction 149 opposite to that of the circulation conveyors, i.e., in the same angular direction 35 as the supply body 34.

With reference to FIGS. 1 and 10, it will be apparent that when the pick roll 88 is rotated in the same angular direction as that of the rotating supply body 34, the fingers or picks 92 gradually egress from the stripper drum 86 to penetrate the supply body 34. The penetrating fingers 92 are thus operative to peel a batt 20 from the rotating supply body 34. Gradually, the fingers 92 retract into the stripper drum 86 so as to permit generally smooth egress of the batt 29 through the exit opening 38.

This egress is, of course, accomplished by the exit conveyor action of the lower conveyor 42 while the surface of the stripper drum 86 acts as a compression roll to aid in exit of the batt. Although the fingers or picks 92 need not retract fully into the stripper drum 86, eventually full retraction adjacent the exit zone is preferable in order to minimize any tendency to lift or tear apart the exiting batt 20.

For a similar reason, the stripping means conveyor belts 130 of FIGS. 8 and 9 are angled away from the exit conveyor section **42*b*. Thus, the picks 136 thereon follow a path away from the exiting batt 20**.

Because the exiting batt 20 is under slight compression during passage between the stripping means and exit conveyor, it expands to full thickness afterwards.

During formation and feeding of the batt 20, the supply body is, of course, being depleted by the amount of exiting cotton. However, a simultaneous build up of the body 34 may be taking place by continuous supply of the precursor batt which becomes part of the supply body by being circulated and/or by the supply of cotton into the retention chamber 32 through its open top. Batts 20 of greater thickness than the precursor batt may be produced so that even then, a net depletion of the body occurs.

The thickness of the batt 20 being peeled from the body may be adjusted by adjusting the relative displacement of the stripping means 36 and the first circulation conveyor 42. In the case of the embodiment of FIG. 1, vertical adjustment of the upright supports 81 accomplishes such thickness adjustment. In the case of the FIG. 9 embodiment, the thickness adjustment may be accomplished by pivoting the bracket assemblies 184 mounting the lower conveyor drive roller 48 toward or away from the stripping means as earlier described. In either case, such adjustment predetermines the uppermost location at which the rotating supply body 34 is engaged by the stripping means 36 to effect peeling of the body. It is thought to be primarily that location, and not necessarily the height of the exit opening 38 or the depth of stripper means penetration, which determines the thickness of the formed batt 20, inasmuch as the supply body 34 is not only being rotated but it is being continuously urged toward the front of the chamber where the stripping means 36 is located. Thus, the cotton in the body 34 below the location of stripping means engagement zone becomes the layer which is primarily peeled to form the batt.

During times when it becomes necessary or desirable to interrupt formation of the cotton bale, the stripping means 36 is deactivated. Advantageously, cotton can still be fed to the retention chamber 32 independently of the fact that feeding of the batt 20 to the bale forming operation is interrupted. During that time, the batt supply body 34 is replenished if the circulation conveyors are being operated, and even if they are not being operated, cotton, for ultimate inclusion in the supply body 34, can be fed into and stored in the retention chamber.

Although formation of the batt supply body 34 has been described in conjuction with a precursor batt, it will be apparent that loose cotton from any suitable source may be supplied to the retention chamber through its open top.

Batt formation and feeding with the apparatus depicted in FIG. 8 and that depicted in FIG. 9 is substantially similar to that described above except for the differences attributable to the difference in the stripping means 36 and the batt feed path after it leaves the exit conveyor section 42*b*.

From the foregoing it will be seen that in accordance with the present invention a novel and advantageous method and apparatus for forming and feeding a cotton batt has been provided.

Of particular significance is the fact that batt uniformity is enhanced through the formation of a rotating batt supply body and the peeling of that body to provide the desired batt.

Also of significance is the particular compatibility of the batt forming method and apparatus with a cotton bale forming system involving the application of pressure over the area of successive cotton layers. In this connection, batt feeding may take place in an interrupted fashion while cotton is continuously supplied to the retention chamber.

Additional advantages stem from the provision for adjusting batt thickness, and the ability to utilize loose cotton and/or a precursor batt as the material from which the batt supply body is formed.

Although the invention has been described with reference to preferred forms thereof it will be appreciated by those skilled in the art that additions, substitutions, modifications and deletions may be made without departing from the spirit and scope of the invention as defined in the impending claims.

What is claimed is:

1. Cotton batt feeding apparatus comprising:

frame means including lateral and upright portions;

cotton retention chamber means on said frame and including a batt exit opening;

first conveyor means in the form of an endless belt on said lateral frame portion for conveying cotton in a generally lateral direction toward said exit opening;

second conveyor means on said frame portion in the form of an endless belt for conveying cotton in said chamber away from said batt exit opening in an upright direction generally transverse to said lateral direction and including an upper idler roll and a lower drive roll spaced from said first conveyor means;

said first and said second conveyor means serving as floor and and end wall portions respectively of said chamber means and being operable to enforce circulation of cotton in said chamber means to establish a rotating batt supply body;

stripping means disposed on said frame means between said lower drive roll of said second conveyor means and said first conveyor means and spaced form said first conveyor means to define the exit opening therebetween;

means for driving said lower drive roll of said second conveyor means and said stripping means, the latter being rotated in a direction to strip a batt of cotton from the rotating batt supply body and direct the batt through the exit opening;

means mounting said lower drive roll of said second conveyor means for arcuate adjustment about the axis of rotation of said stripping means to adjust the angular relationship of said second conveyor means to said first conveyor means without changing the size of said exit opening or the spacing between said lower drive roll and said stripping means; and means for adjusting the position of the upper idler roll of said second conveyor means to maintain uniform spacing between said idler roll and said lower drive roll of said second conveyor means.

2. Apparatus as recited in claim 1. wherein;

said first conveyor means has a drive roll at its front end and means are provided for adjusting said drive roll in a generally arcuate direction on said lateral frame portion to adjust the upright dimension of the batt exit opening.

* * * * *